US008941326B2

(12) United States Patent
Li et al.

(10) Patent No.: US 8,941,326 B2
(45) Date of Patent: Jan. 27, 2015

(54) AC-DC DUAL-USE LED DRIVING CIRCUIT

(75) Inventors: Yan-Cun Li, Hsinchu (TW); Hsing-Fu Liu, Hsinchu (TW); Jui-Chi Chang, Hsinchu (TW); Po-Yao Yeh, Hsinchu (TW)

(73) Assignee: Macroblock, Inc., Hsinchu (TW)

( * ) Notice: Subject to any disclaimer, the term of this patent is extended or adjusted under 35 U.S.C. 154(b) by 634 days.

(21) Appl. No.: 13/346,851

(22) Filed: Jan. 10, 2012

(65) Prior Publication Data

US 2012/0313548 A1 Dec. 13, 2012

(30) Foreign Application Priority Data

Jun. 8, 2011 (TW) ..... 100120049 A

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.

CPC ..... *H05B 33/0809* (2013.01); *H05B 33/0815* (2013.01); *H05B 33/0818* (2013.01)

USPC ..... 315/307; 315/209 R; 315/224; 315/225; 315/291

(58) Field of Classification Search

None

See application file for complete search history.

(56) References Cited

U.S. PATENT DOCUMENTS

| | | | | |
|---|---|---|---|---|
| 7,391,630 | B2 | 6/2008 | Acatrinei | |
| 8,120,277 | B2 * | 2/2012 | McKinney | 315/294 |
| 2012/0019714 | A1 * | 1/2012 | Hiramatu et al. | 348/370 |

* cited by examiner

*Primary Examiner* — Anh Tran

(74) *Attorney, Agent, or Firm* — Morris Manning & Martin LLP; Tim Tingkang Xia, Esq.

(57) ABSTRACT

An Alternating-current-Direct-current (AC-DC dual-use) Light Emitting Diode (LED) driving circuit includes an input power circuit, a buck-boost converter, and a Pulse Width Modulation (PWM) signal controller. The buck-boost converter, including a switching transistor and a feedback resistor, receives a current signal output from the input power circuit, and drives an LED with a driving signal. The PWM signal controller outputs a PWM signal according to the driving signal, so as to sequentially turn on and turn off the switching transistor. One end of the feedback resistor is coupled to the LED, and a floating ground terminal of the PWM signal controller is coupled to the switching transistor and the other end of the feedback resistor. Therefore, the AC-DC dual-use LED driving circuit is capable of dynamically adjusting the duty ratio of the PWM signal without connecting an external photocoupler.

16 Claims, 7 Drawing Sheets

AC-DC DUAL-USE LED DRIVING CIRCUIT

CROSS-REFERENCE TO RELATED APPLICATIONS

This non-provisional application claims priority under 35 U.S.C. §119(a) on Patent Application No(s). 100120049 filed in Taiwan, R.O.C. on Jun. 8, 2011, the entire contents of which are hereby incorporated by reference.

BACKGROUND

1. Technical Field

The disclosure relates to a Light Emitting Diode (LED) driving circuit, and more particularly to an Alternating-current-to-Direct-current (AC-to-DC) LED driving circuit.

2. Related Art

Recently, with increasing awareness of environmental protection, how to save energy has become an important topic. With respect to devices for illumination, LEDs, compared with common light emitting sources, are advantageous in having long service life, low power consumption, and being not easily damaged, and thus they are developed vigorously and play a critical role in daily life.

A conventional LED driving circuit includes a transformer, a Pulse Width Modulation (PWM) Integrated Circuit (IC), a constant-current circuit, and a feedback circuit. The transformer includes a primary side and a secondary side, and the feedback circuit includes a sensing resistor and a photocoupler. The PWM IC is electrically coupled to the primary side of the transformer, and the constant-current circuit is electrically coupled to the secondary side of the transformer. By the current passing trough the sensing resistor and the photocoupler, the feedback circuit couples a feedback signal to the PWM IC. The photocoupler receives the optical signal of the secondary side to generate a feedback signal, and the PWM IC receives the feedback signal to adjust the duty ratio of the PWM signal, wherein the duty ratio means the sustaining time of the PWM signal during which the voltage of the PWM signal remains high level in a duty cycle.

Accordingly, the LED driving circuit requires the photocoupler to couple the feedback signal to the PWM IC, thereby adjusting the duty ratio of the PWM signal output from the PWM IC. Therefore, the conventional LED driving circuit must employ more elements, a larger accommodation space is needed, and the manufacturing cost is also increased.

SUMMARY

Accordingly, the disclosure is an AC-DC DUAL-USE LED driving circuit for solving the problems existing in the prior art.

In an embodiment of the disclosure, the AC-DC DUAL-USE LED driving circuit comprises an input power circuit, a buck-boost converter, and a PWM signal controller. The buck-boost converter comprises a switching transistor and a feedback resistor. The buck-boost converter receives a current signal output from the input power circuit and then outputs a driving signal, and the AC-DC DUAL-USE LED driving circuit drives LEDs by using the driving signal. The PWM signal controller outputs a PWM signal according to the driving signal for sequentially turning on and turning off the switching transistor.

One end of the feedback resistor is coupled to the LED, and a floating ground terminal of the PWM signal controller is coupled to the switching transistor and the other end of the feedback resistor.

In an embodiment, the input power circuit comprises an AC signal source, a first filter, and a bridge rectifier. The AC signal source outputs an AC signal to the first filter, and the first filter filers off noises in the AC signal. The bridge rectifier receives the AC signal passing through the first filter, and then outputs a current signal.

In an embodiment, the input power circuit is a DC signal source.

In an embodiment, the AC-DC DUAL-USE LED driving circuit which is suitable for driving an LED comprises an input power circuit, a buck-boost converter and a PWM signal controller. The buck-boost converter comprises a switching transistor, a feedback resistor, a low pass filter and a free-wheeling diode. One end of the free-wheeling diode is connected to the low pass filter and the other end of the free-wheeling diode is connected to the LED. A floating ground terminal of the PWM signal controller is coupled to both the switching transistor and the low pass filter. Two ends of the feedback resistor are connected to the floating ground terminal and the low pass filter, respectively. The buck-boost converter is used for receiving a current signal from the input power circuit and outputting a driving signal. The AC-DC dual-use LED driving circuit is used to drive the LED by using the driving signal. The PWM signal controller is used to output a PWM signal according to a feedback signal passing through the low pass filter for sequentially turning on and turning off the switching transistor The AC-DC dual-use LED driving circuit according to the disclosure is suitable for driving an LED. Through making the buck-boost converter and the PWM signal controller having a common ground, the AC-DC dual-use LED driving circuit can dynamically adjust the duty ratio of the PWM signal without connecting to an external photocoupler. When the input power circuit comprises an AC signal source, the power factor of the AC-DC dual-use LED driving circuit can be improved, wherein the power factor is a ratio of an effective power to an apparent power. When the input power circuit is a DC signal source, the current (the driving signal) for driving the LED is a constant, no matter whether the voltage of the DC signal source is higher or lower than that of an output terminal (the voltage of a second capacitor). No matter whether the input power circuit comprises the AC signal source or the DC signal source, the high frequency signals in the transformed signal $I_D$ which passes through the free-wheeling diode is filtered out by the low pass filter. Then, the PWM signal controller receives the feedback signal and then outputs the corresponding PWM signal.

BRIEF DESCRIPTION OF THE DRAWINGS

The disclosure will become more fully understood from the detailed description given herein below for illustration only, and thus are not limitative of the disclosure, and wherein.

DETAILED DESCRIPTION

Figure 1:
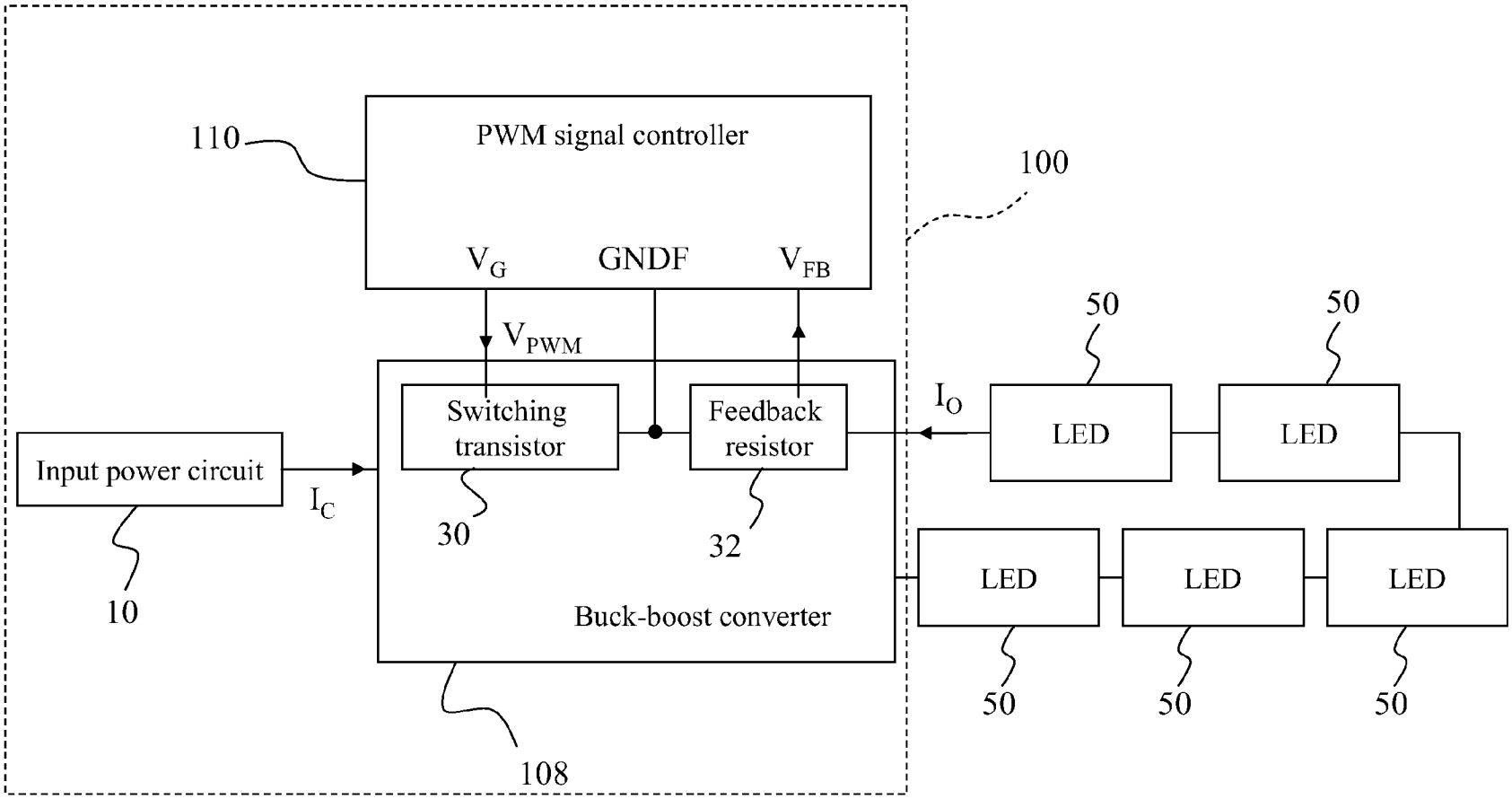
FIG. 1 is a schematic circuit block diagram of an AC-DC dual-use LED driving circuit according to an embodiment of the disclosure.

FIG. 1 is a schematic circuit block diagram of an AC-DC dual-use LED driving circuit according to an embodiment of the disclosure. The AC-DC dual-use LED driving circuit 100 is suitable for driving five LEDs 50. In this embodiment, the number of the LEDs 50 may be, but not limited to, five, and the LEDs 50 may be connected in series; however, this embodiment is not intended to limit the disclosure. That is to say, the number of the LEDs 50 may be ten. Besides, in some embodiments, the LEDs 50 may be connected in parallel, which can be adjusted according to various requirements.

The AC-DC dual-use LED driving circuit 100 comprises an input power circuit 10, a buck-boost converter 108, and a PWM signal controller 110. The buck-boost converter 108 comprises a switching transistor 30 and a feedback resistor 32. One end of the feedback resistor 32 is coupled to one of the five LEDs 50, and a floating ground terminal GNDF of the PWM signal controller 110 is coupled to the switching transistor 30 and the other end of the feedback resistor 32.

The input power circuit 10 is used to output a current signal $I_C$, and the buck-boost converter 108 receives the current signal $I_C$ and outputs a driving signal $I_O$. The AC-DC dual-use LED driving circuit 100 drives the five LEDs 50 by the driving signal $I_O$. The PWM signal controller 110 outputs a PWM signal $V_{PWM}$ according to the driving signal $I_O$ for sequentially turning on and turning off the switching transistor 30. The PWM signal controller 110 may be, but not limited to, a control circuit in a voltage mode.

Figure 2:
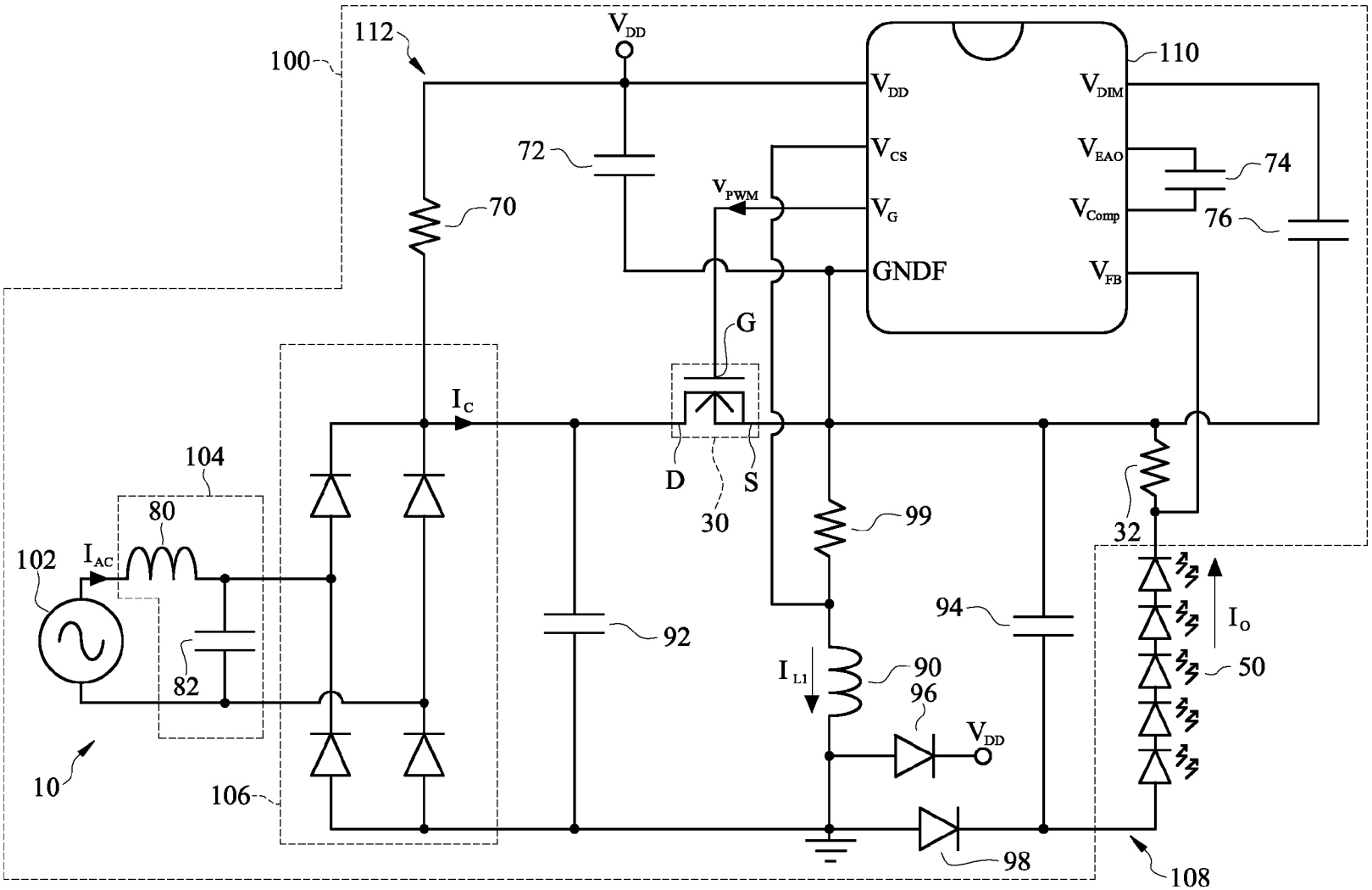
FIG. 2 is a schematic structural view of a circuit according to Embodiment 1 of FIG. 1.

FIG. 2 is a schematic structural view of a circuit according to Embodiment 1 of FIG. 1. In this embodiment, the input power circuit 10 may comprise an AC signal source 102, a first filter 104, and a bridge rectifier 106. The first filter 104 may comprise a filter inductor 80 and a first filter capacitor 82. The filter inductor 80 may be connected to the AC signal source 102 in series, and connected to the AC signal source 102 in parallel. In this embodiment, the switching transistor 30 is an N-channel Metal-Oxide Semiconductor Field Effect Transistor (NMOSFET). However, this embodiment is not intended to limit this disclosure. In some embodiments, the switching transistor 30 may also be a Bipolar Junction Transistor (BJT) or a P-channel Metal-Oxide Semiconductor Field Effect Transistor (PMOSFET). The PWM signal controller 110 may comprise the floating ground terminal GNDF, a feedback terminal $V_{FB}$, and a control terminal $V_G$. One end of the feedback resistor 32 is coupled to the LED 50, and the floating ground terminal GNDF is coupled to the switching transistor 30 (that is, a source S of the NMOSFET) and the other end of the feedback resistor 32. The control terminal $V_G$ is coupled to a gate G of the switching transistor 30, and a drain D of the switching transistor 30 is coupled to the bridge rectifier 106.

The AC signal source 102 outputs an AC signal $I_{AC}$ to the first filter 104, and the first filter 104 filters out noises in the AC signal $I_{AC}$. The bridge rectifier 106 receives the AC signal $I_{AC}$ passing through the first filter 104 and outputs the current signal $I_C$. The buck-boost converter 108 receives the current signal $I_C$ and outputs the driving signal $I_O$, and the AC-DC dual-use LED driving circuit 100 drives the five LEDs 50 by the driving signal $I_O$. The PWM signal controller 110 outputs the PWM signal $V_{PWM}$ according to the driving signal $I_O$ for sequentially turning on and turning off the switching transistor 30 (that is, the NMOSFET). The detailed operation process of the AC-DC dual-use LED driving circuit 100 is described hereinafter.

In addition, in this and some embodiments, the AC-DC dual-use LED driving circuit 100 further comprises a power control unit 112, and the power control unit 112 is used to power the PWM signal controller 110. The power control unit 112 may comprise a starting resistor 70, a second filter capacitor 72, and a first diode 96. One end of the starting resistor 70 is coupled to the bridge rectifier 106, and the other end of the starting resistor 70 is coupled to a circuit voltage terminal $V_{DD}$. One end of the second filter capacitor 72 is coupled to the circuit voltage terminal $V_{DD}$, the other end of the second filter capacitor 72 is coupled to the floating ground terminal GNDF, and an output terminal of the first diode 96 is coupled to the circuit voltage terminal $V_{DD}$. The circuit voltage terminal $V_{DD}$ is used for receiving the working voltage of the PWM signal controller 110.

When the voltage of the second filter capacitor 72 (that is, the voltage of the circuit voltage terminal $V_{DD}$) does not reaches the working voltage of the PWM signal controller 110 yet, the current signal $I_C$ output by the bridge rectifier 106 charges the second filter capacitor 72 through the starting resistor 70. When the voltage of the second filter capacitor 72 (that is, the voltage of the circuit voltage terminal $V_{DD}$) reaches the working voltage of the PWM signal controller 110, the PWM signal controller 110 may start to output the PWM signal $V_{PWM}$ for sequentially turning on and turning off the switching transistor 30 (that is, the NMOSFET). After powered by the power control unit 112 through the starting resistor 70, the PWM signal controller 110 is then powered by the power control unit 112 through the first diode 96. The buck-boost converter 108 may further comprise a first inductor 90, a second capacitor 94, a second diode 98, and a sensing resistor 99. One end of the first inductor 90 is grounded, and coupled to an input terminal of the first diode 96 and an input terminal of the second diode 98, and the other end of the first inductor 90 is coupled to the sensing resistor 99. An output terminal of the second diode 98 is coupled to one end of the second capacitor 94, and the other end of the second capacitor 94 is coupled to the floating ground terminal GNDF. One end of the sensing resistor 99 is coupled to the floating ground terminal GNDF. The PWM signal controller 110 detects a first current $I_{L1}$ passing through the first inductor 90, and limits the value of the first current $I_{L1}$ via the sensing resistor 99 so as to protect the switching transistor 30 and the second diode 98.

In this embodiment, the buck-boost converter 108 may also comprise a first capacitor 92, one end of the first capacitor 92 is grounded, and the other end is coupled to the drain D of the switching transistor 30. The first capacitor 92 may be used to filter out the noises in the current signal $I_C$; however, this embodiment is not intended to limit the disclosure.

The PWM signal controller 110 may further comprise a compensator 74, a third filter capacitor 76, an error amplification terminal $V_{EAO}$, a compensation terminal $V_{Comp}$, a light adjusting terminal $V_{DIM}$, and a protection terminal $V_{CS}$. One end of the compensator 74 is coupled to the error amplification terminal $V_{EAO}$, and the other end of the compensator 74 is coupled to the compensation terminal $V_{Comp}$. One end of the third filter capacitor 76 is coupled to the light adjusting terminal $V_{DIM}$, and the other end of the third filter capacitor 76 is coupled to the floating ground terminal GNDF. The protection terminal $V_{CS}$ is coupled to the first inductor 90 and the other end of the sensing resistor 99.

Figure 3:
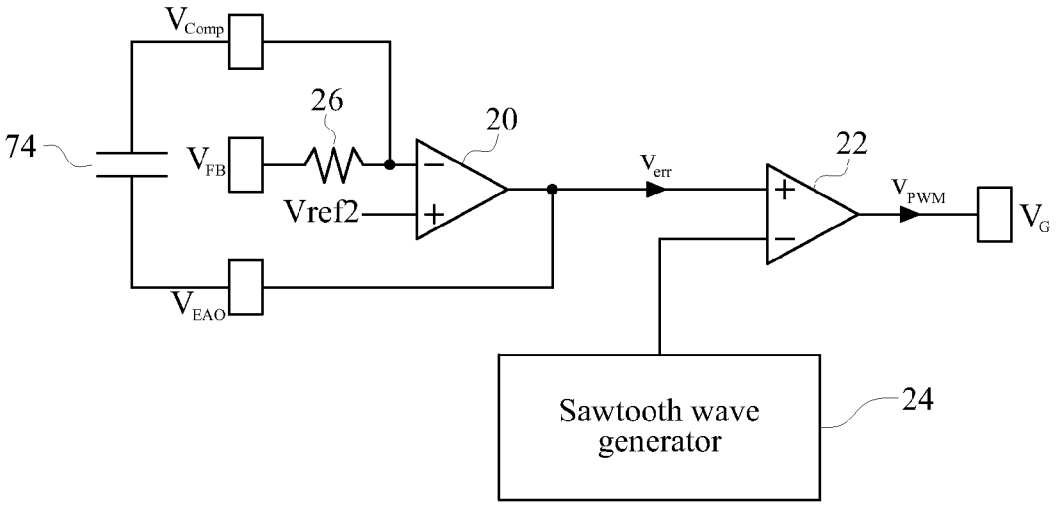
FIG. 3 is a schematic view of circuit architecture according to an embodiment of an error amplification terminal, a compensation terminal, a feedback terminal, and a control terminal as shown in FIG. 2.
Figure 4A:
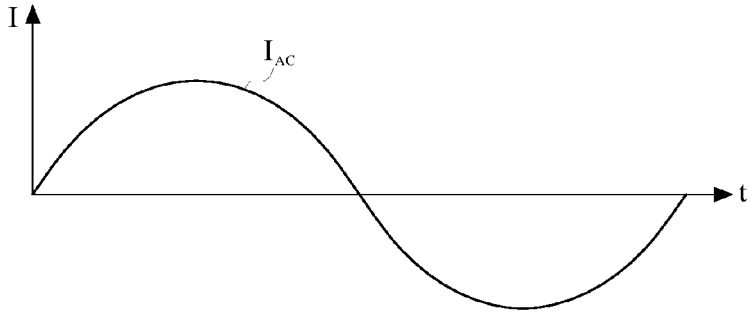
FIG. 4A is a timing diagram of a signal waveform of an AC signal according to an embodiment of the circuit architecture as shown in FIG. 2.
Figure 4B:
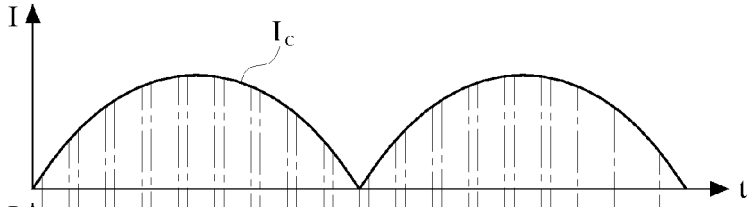
FIG. 4B is a timing diagram of a signal waveform of a current signal according to an embodiment of the circuit architecture as shown in FIG. 2.
Figure 4C:
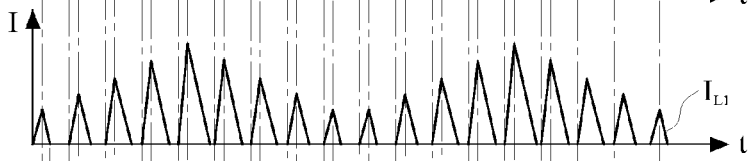
FIG. 4C is a timing diagram of a signal waveform of a first current according to an embodiment of the circuit architecture as shown in FIG. 2.
Figure 4D:
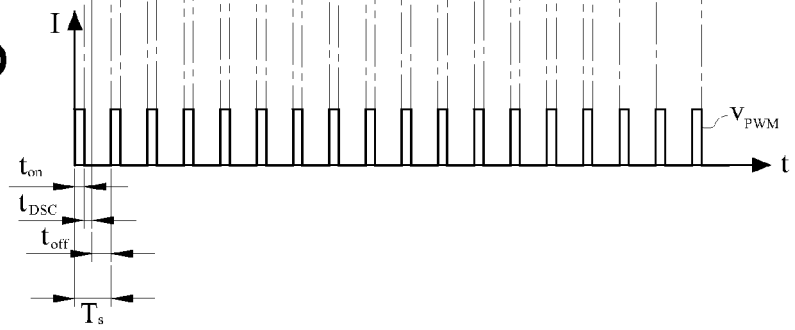
FIG. 4D is a timing diagram of a signal waveform of a PWM signal according to an embodiment of the circuit architecture as shown in FIG. 2.
Figure 4E:
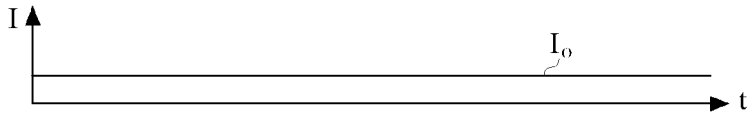
FIG. 4E is a timing diagram of a signal waveform of a driving signal according to an embodiment of the circuit architecture as shown in FIG. 2.

FIG. 3 is a schematic view of circuit comprising the error amplification terminal, the compensation terminal, the feedback terminal, and the control terminal as shown in FIG. 2 according to an embodiment. The PWM signal controller 110 may further comprise an error amplification unit 20, a comparator 22, a sawtooth-wave generator 24, and an operation resistor 26. A positive input terminal of the error amplification unit 20 is coupled to a reference voltage $V_{ref2}$. A negative input terminal of the error amplification unit 20 is coupled to the compensation terminal $V_{Comp}$ and one end of the operation resistor 26. The other end of the operation resistor 26 is coupled to the feedback terminal $V_{FB}$. An output terminal of the error amplification unit 20 is coupled to a positive input terminal of the comparator 22, the sawtooth-wave generator 24 is coupled to a negative input terminal of the comparator 22, and an output terminal of the comparator 22 is coupled to the control terminal $V_G$.

More particularly, referring to FIGS. 2, 3, 4A, 4B, 4C, 4D, and 4E, FIGS. 4A to 4E are respectively timing diagrams of signal waveforms of an AC signal, a current signal, a first current, a PWM signal, and a driving signal according to an embodiment of the circuit architecture as shown in FIG. 2. The AC signal source 102 outputs an AC signal $I_{AC}$ to the first filter 104, and the first filter 104 filters off noises in the AC signal $I_{AC}$. The bridge rectifier 106 receives the AC signal $I_{AC}$ passing through the first filter 104 and outputs a current signal $I_C$ to the buck-boost converter 108, and the buck-boost converter 108 receives the current signal $I_C$ and outputs a driving signal $I_O$ so as to drive the five LEDs. The PWM signal controller 110 receives the driving signal $I_O$ through the feedback terminal $V_{FB}$. Then, an error amplification operation program may be performed by the operation resistor 26, the error amplification unit 20, and the compensator 74 for calculating the driving signal $I_O$ and signals received by the error amplification terminal $V_{EAO}$ and the compensation terminal $V_{Comp}$ so as to output an error amplified signal $V_{err}$. To output a PWM signal $V_{PWM}$ (the cycle of the $V_{PWM}$ is $T_S$), a comparison process which compares the error amplified signal $V_{err}$ to the signal generated by the sawtooth-wave generator 24 is then performed by the comparator 22.

When the PWM signal $V_{PWM}$ is at a high level (that is, the $V_{PWM}$ is within a period $t_{on}$), since the switching transistor 30 is turned on, the first current $I_{L1}$ passing through the first inductor 90 is linear and proportional to time. When the PWM signal $V_{PWM}$ is at a low level and within a period $t_{DSC}$, the switching transistor 30 is turned off, the second diode 98 is turned on, and the first inductor 90 supplies power to the second capacitor 94 and the LED 50 so the first current $I_{L1}$ passing through the first inductor 90 is linear and inversely proportional to time. When the PWM signal $V_{PWM}$ is at a low level and within a period $t_{off}$, the switching transistor 30 keeps in an off state, and the first current $I_{L1}$ passing through the first inductor 90 is reset, such that the second diode 98 is turned off. Therefore, the signal received by the protection terminal $V_{CS}$ (that is, the first current $I_{L1}$ passing through the first inductor 90) may be in, but not limited to, a Discontinuous Current Mode (DCM).

In this embodiment, the PWM signal $V_{PWM}$ has a constant period $T_s$ (that is to say, the PWM signal $V_{PWM}$ has a constant frequency); however, this embodiment is not intended to limit the disclosure. In some embodiments, the frequency of the PWM signal $V_{PWM}$ is not a constant. The frequency of the PWM signal $V_{PWM}$ may be related to the frequency of the sawtooth-wave generator 24.

Figure 5:
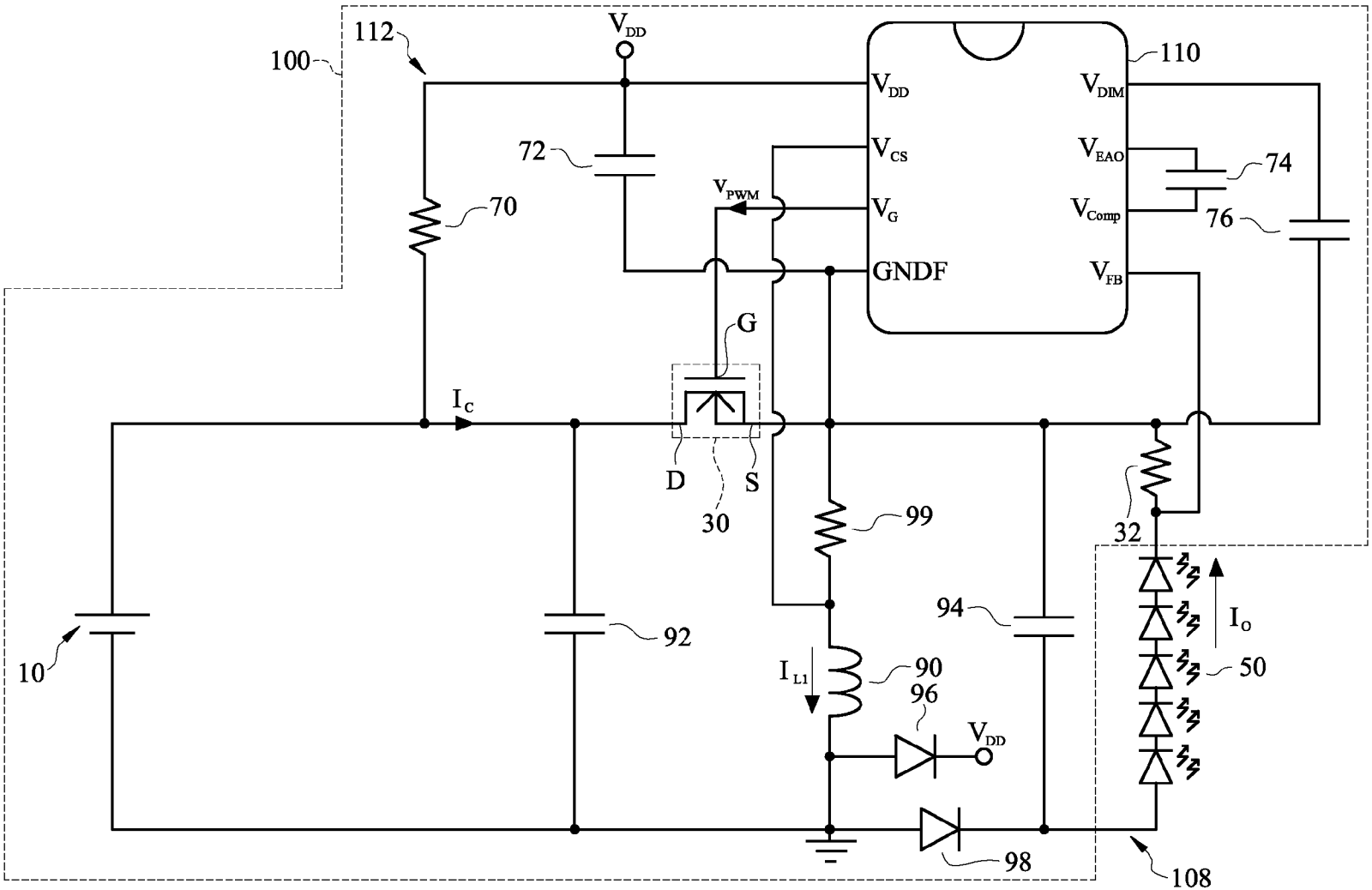
FIG. 5 is a schematic structural view of a circuit according to Embodiment 2 of FIG. 1.

FIG. 5 is a schematic structural view of a circuit according to Embodiment 2 of FIG. 1. In this embodiment, the input power circuit 10 may be a DC signal source. The buck-boost converter 108 receives the current signal $I_C$ output from the DC signal source and outputs the driving signal $I_O$, and the AC-DC dual-use LED driving circuit 100 drives the five LEDs 50 by using the driving signal $I_O$. The PWM signal controller 110 outputs the PWM signal $V_{PWM}$ according to the driving signal $I_O$ so as to sequentially turn on and turn off the switching transistor 30. In this embodiment, ways of the PWM signal controller 110 outputting the PWM signal $V_{PWM}$ according to the driving signal $I_O$ for sequentially turning on and off the switching transistor 30 is similar to those described in the embodiment of FIG. 2. They are not repeated for conciseness.

Figure 6:
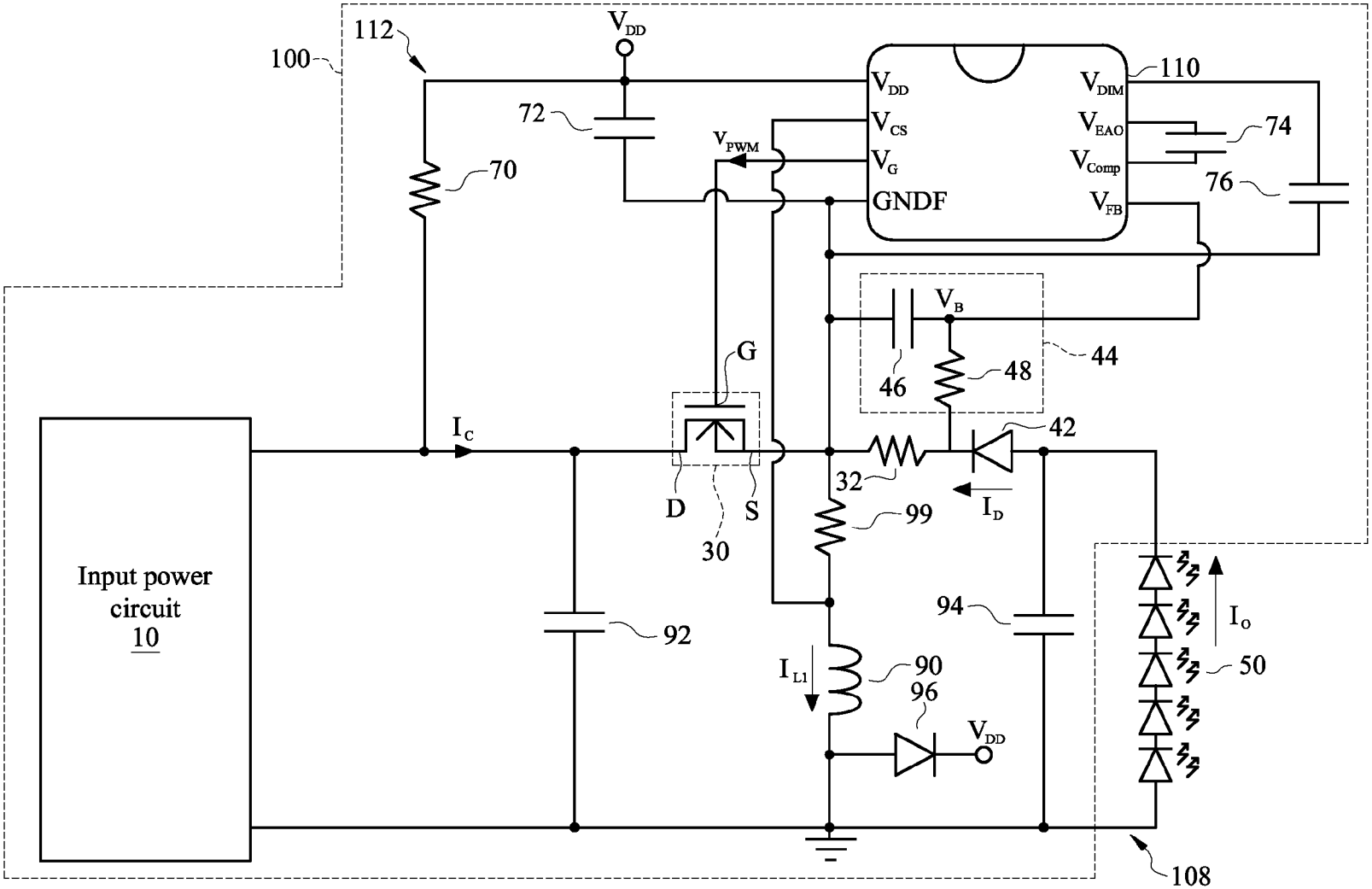
FIG. 6 is a schematic circuit block diagram of an AC-DC dual-use LED driving circuit according to an embodiment of the disclosure.
Figure 7A:
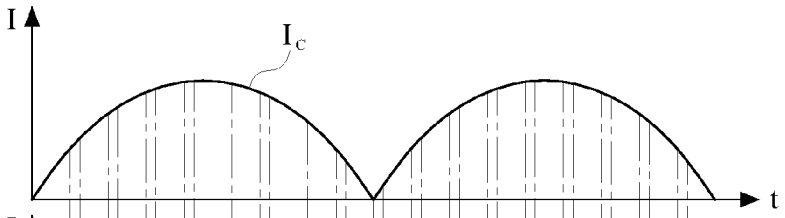
FIG. 7A is a timing diagram of a signal waveform of an current signal according to an embodiment of the circuit architecture as shown in FIG. 6.
Figure 7B:
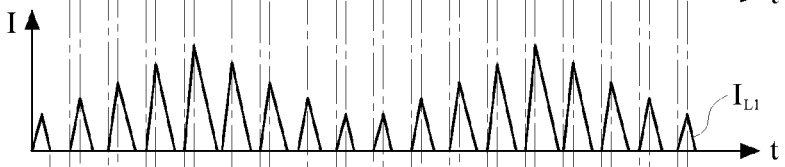
FIG. 7B is a timing diagram of a signal waveform of a first current according to an embodiment of the circuit architecture as shown in FIG. 6.
Figure 7C:
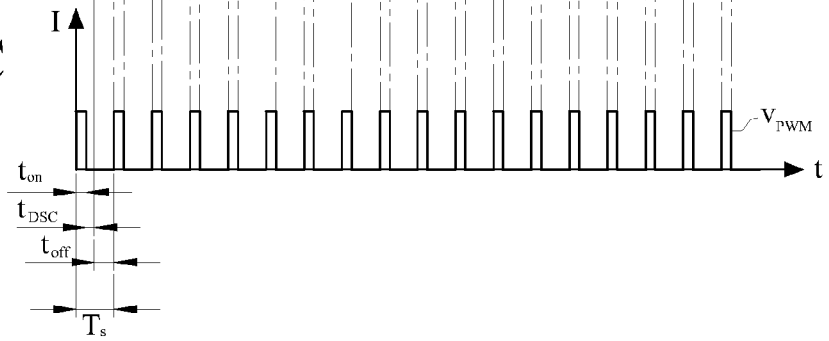
FIG. 7C is a timing diagram of a signal waveform of a PWM signal according to an embodiment of the circuit architecture as shown in FIG. 6.
Figure 7D:
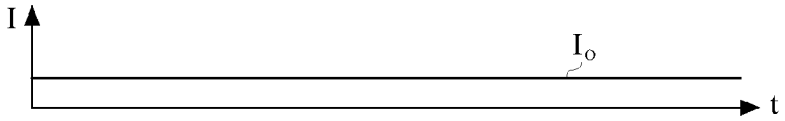
FIG. 7D is a timing diagram of a signal waveform of a driving signal according to an embodiment of the circuit architecture as shown in FIG. 6.
Figure 7E:
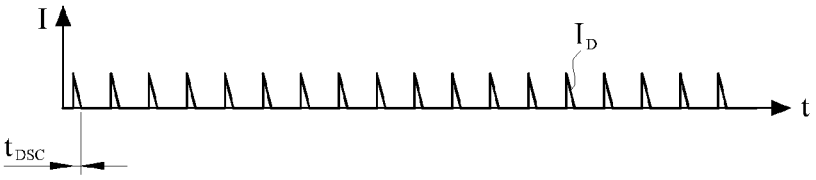
FIG. 7E is a timing diagram of a signal waveform of a transformed signal according to an embodiment of the circuit architecture as shown in FIG. 6.
Figure 7F:
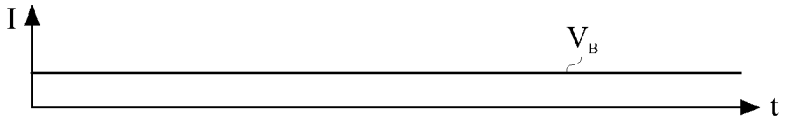
FIG. 7F is a timing diagram of a signal waveform of a feedback signal according to an embodiment of the circuit architecture as shown in FIG. 6.

FIG. 6 is a schematic circuit block diagram of an AC-DC dual-use LED driving circuit according to an embodiment of the disclosure. In this embodiment, the AC-DC dual-use LED driving circuit 100 is suitable for driving five LEDs 50. The number of the LEDs 50 may be, but not limited to, five, and the LEDs 50 may be connected in series; however, this embodiment is not intended to limit the disclosure. That is to say, the number of the LEDs 50 may be ten. In some embodiments, the LEDs 50 may be connected in parallel, which can be adjusted according to various requirements.

The AC-DC dual-use LED driving circuit 100 comprises an input power circuit 10, a buck-boost converter 108, and a PWM signal controller 110. In this embodiment, the input power circuit 10 may be the same as the input power circuit in the FIG. 2 or FIG. 5. Besides the switching transistor 30, the feedback resistor 32, the first inductor 90, the second capacitor 94, the sensing resistor 99 and the first capacitor 92, which are also employed by the buck-boost converter 108 in FIG. 2, the buck-boost converter 108 in FIG. 6 further comprises a low pass filter 44 and a free-wheeling diode 42. One end of the free-wheeling diode 42 is connected to the low pass filter 44 and the other end of the free-wheeling diode 42 is connected to one of the five LEDs. The floating ground terminal GNDF of the PWM signal controller 110 is connected to both the switching transistor 30 and the low pass filter 44. The two ends of the feedback resistor 32 are connected to the floating ground terminal GNDF and the low pass filter 44, respectively.

In this embodiment, the low pass filter 44 comprises a second filter capacitor 46 and a filter resistor 48. One end of the second filter capacitor 46 is connected to the floating ground terminal GNDF, and the other end of the second filter capacitor 46 is connected to one end of the filter resistor 48. The other end of the filter resistor 48 is connected to both the feedback resistor 32 and the free-wheeling diode 42.

The input power circuit 10 is used to output the current signal $I_C$, and the buck-boost converter 108 receives the current signal $I_C$ and outputs the driving signal $J_O$. The AC-DC dual-use LED driving circuit 100 drives the five LEDs 50 by the driving signal $I_O$. A transformed signal $I_D$ passing through the free-wheeling diode 42 is received by the low pass filter 44, and the low pass filter 44 filters out the high frequency signals in the transformed signal $I_D$ in order to make the filtered transformed signal $I_D$, i.e. a feedback signal $V_B$, similar to the driving signal. After receiving the filtered transformed signal $I_D$ through the feedback terminal $V_{FB}$, the PWM signal controller 110 outputs the PWM signal $V_{PWM}$ for sequentially turning on and off the switching transistor 30. In this embodiment, the PWM signal controller 110 may be, but is not limited to, a circuit in voltage mode.

FIGS. 7A to 7F are timing diagrams of signal waveforms of a current signal, a first current, a PWM signal, a driving signal, a transformed signal and a feedback signal according to an embodiment of the circuit architecture as shown in FIG. 6. Referring to FIG. 3, FIG. 6 and FIGS. 7A~7F, the input power circuit 10 in FIG. 6 is the same as the input power circuit in the FIG. 2. However, this embodiment is not intended to limit the input power circuit of this disclosure. The buck-boost converter 108 receives the current signal $I_C$ from the input power circuit 10, and outputs a driving signal $I_O$ for driving the five LEDs 50. Until the voltage of the second filer capacitor 72 reaches the working voltage of the PWM signal controller 110, the second filter capacitor 72 is charged by the current signal $I_C$ which is outputted by the input power circuit 10 and passes through the starting resistor 70. After the voltage of the second filer capacitor 72 reaches the working voltage of the PWM signal controller 110, the signal received by the feedback terminal $V_{FB}$, i.e. the feedback signal $V_B$, and the signals received by the error amplification terminal $V_{EAO}$ and the compensation terminal $V_{Comp}$ are processed by the operation resistor 26, the error amplification unit 20, and the compensator 74 to perform the error amplification operation program, so that the error amplified signal $V_{err}$ is generated. Then, the error amplified signal $V_{err}$ is processed by the sawtooth-wave generator 24 and the comparator 22 for performing the comparison, so that the PWM signal $V_{PWM}$ is generated for sequentially turning on and off the switching transistor 30, i.e. an NMOSFET, wherein the period of the $V_{PWM}$ is $T_S$. After the moment that the power control unit 112 powers the PWM signal controller 110, the first diode 96 is used by the power control unit 112 to supply power to the PWM signal controller 110.

When the PWM signal $V_{PWM}$ is at a high level (that is, the $V_{PWM}$ is within a period $t_{on}$), since the switching transistor 30 is turned on, the first current $I_{L1}$ passing through the first inductor 90 is linear and proportional to time. When the PWM signal $V_{PWM}$ is at a low level and within a period $t_{DSC}$, the switching transistor 30 is turned off, the free-wheeling diode 42 is turned on, and the first inductor 90 supplies power to the second capacitor 94 and the LED 50, such that the first current $I_{L1}$ passing through the first inductor 90 is linear and inversely proportional to time and that the transformed signal $I_D$ passing through the free-wheeling diode 42 is also linear and inversely proportional to time. When the PWM signal $V_{PWM}$ is at a low level and within a period $t_{off}$, the switching transistor 30 keeps in an off state, and the first current $I_{L1}$ passing through the first inductor 90 is reset so the free-wheeling diode 42 is turned off. Therefore, the signal received by the protection terminal $V_{CS}$ (that is, the first current $I_{L1}$ passing through the first inductor 90) may be in, but not limited to, a Discontinuous Current Mode (DCM).

In this embodiment, the PWM signal $V_{PWM}$ has a constant period $T_s$ (that is to say, the PWM signal $V_{PWM}$ has a constant frequency); however, this embodiment is not intended to limit the disclosure. In some embodiments, the frequency of the PWM signal $V_{PWM}$ is not a constant. The frequency of the PWM signal $V_{PWM}$ may be related to the frequency of the sawtooth-wave generator. The AC-DC dual-use LED driving circuit according to the disclosure is suitable for driving an LED. Through making the buck-boost converter and the PWM signal controller having a reference point (i.e. a floating ground) the AC-DC dual-use LED driving circuit can dynamically adjust the duty ratio of the PWM signal without connecting an external photocoupler. The duty ratio of the PWM signal is related to the magnitude of the driving signal for driving the LED. When the input power circuit comprises an AC signal source, the power factor of the AC-DC dual-use LED driving circuit can be improved, wherein the power factor is a ratio of an effective power to an apparent power. When the input power circuit is a DC signal source, no matter whether the voltage of the DC signal source is higher or lower than that of an output terminal (the voltage of a second capacitor), the current (the driving signal) for driving the LED remains a constant. No matter whether the input power circuit comprises the AC signal source or the DC signal source, the high frequency signals in the transformed signal $I_D$ which passes through the free-wheeling diode is filtered out by the low pass filter. Then, the PWM signal controller receives the feedback signal and then outputs the corresponding PWM signal.

What is claimed is:

1. An Alternating-current-Direct-current (AC-DC) dual-use Light Emitting Diode (LED) driving circuit, suitable for driving an LED, comprising:

an input power circuit for outputting a current signal;

a buck-boost converter for receiving the current signal and outputting a driving signal, the AC-DC dual-use LED driving circuit driving the LED by the driving signal, the buck-boost converter comprising a switching transistor and a feedback resistor, and one end of the feedback resistor coupled to the LED; and a Pulse Width Modulation (PWM) signal controller for outputting a PWM signal according to the driving signal for sequentially turning on and turning off the switching transistor, a floating ground terminal of the PWM signal controller coupled to the switching transistor and the other end of the feedback resistor.

2. The AC-DC dual-use LED driving circuit according to claim 1, wherein the input power circuit comprises:

an AC signal source for outputting an AC signal;

a first filter for filtering off a noise in the AC signal; and a bridge rectifier for receiving the AC signal passing through the first filter and outputting the current signal.

3. The AC-DC dual-use LED driving circuit according to claim 1, wherein the input power circuit is a DC signal source.

4. The AC-DC dual-use LED driving circuit according to claim 1, wherein a frequency of the PWM signal is not a constant.

5. The AC-DC dual-use LED driving circuit according to claim 1, wherein the frequency of the PWM signal is a constant.

6. The AC-DC dual-use LED driving circuit according to claim 1, wherein the PWM signal controller further comprises a feedback terminal and a control terminal, the feedback terminal is used for receiving the DC signal, and the control terminal is used for outputting the PWM signal.

7. The AC-DC dual-use LED driving circuit according to claim 1, wherein the PWM signal controller is a control circuit in a voltage mode.

8. The AC-DC dual-use LED driving circuit according to claim 1, wherein the buck-boost converter further comprises a first inductor, and a first current passing through the first inductor is in a Discontinuous Current Mode (DCM).

9. An Alternating-current-Direct-current (AC-DC) dual-use Light Emitting Diode (LED) driving circuit, suitable for driving an LED, comprising:

an input power circuit for outputting a current signal;

a buck-boost converter for receiving the current signal and outputting a driving signal, the AC-DC dual-use LED driving circuit driving the LED by using the driving signal, the buck-boost converter comprising a switching transistor a feedback resistor, a low pass filter and a free-wheeling diode, and one end of the free-wheeling diode connected to the low pass filter and the other end of the free-wheeling diode connected to the LED; and a PWM signal controller for outputting a PWM signal according to a feedback signal passing through the low pass filter for sequentially turning on and turning off the switching transistor, a floating ground terminal of the PWM signal controller coupled to the switching transistor and the low pass filter and the two ends of the feedback resistor respectively connected to the floating ground terminal and the low pass filter.

10. The AC-DC dual-use LED driving circuit according to claim 9, wherein the input power circuit comprises:

an AC signal source for outputting an AC signal;

a first filter for filtering off a noise in the AC signal; and a bridge rectifier for receiving the AC signal passing through the first filter and outputting the current signal.

11. The AC-DC dual-use LED driving circuit according to claim 9, wherein the input power circuit is a DC signal source.

12. The AC-DC dual-use LED driving circuit according to claim 9, wherein a frequency of the PWM signal is not a constant.

13. The AC-DC dual-use LED driving circuit according to claim 9, wherein the frequency of the PWM signal is a constant.

14. The AC-DC dual-use LED driving circuit according to claim 9, wherein the PWM signal controller further comprises a feedback terminal and a control terminal, the feedback terminal is used for receiving the feedback signal, and the control terminal is used for outputting the PWM signal.

15. The AC-DC dual-use LED driving circuit according to claim 9, wherein the PWM signal controller is a control circuit in a voltage mode.

16. The AC-DC dual-use LED driving circuit according to claim 9, wherein the buck-boost converter further comprises a first inductor, and a first current passing through the first inductor is in a Discontinuous Current Mode (DCM).

* * * * *